United States Patent [19]

Braukmann

[11] Patent Number: 4,498,206

[45] Date of Patent: Feb. 12, 1985

[54] VACUUM HEAD FOR CLEANING UNDERWATER SURFACES

[76] Inventor: Heinz W. Braukmann, 98 Heathcote Ave., Willowdale, Ontario, Canada, M2L 1Z4

[21] Appl. No.: 487,230

[22] Filed: Apr. 21, 1983

[30] Foreign Application Priority Data

Mar. 22, 1983 [CA] Canada ..... 424164

[51] Int. Cl.[3] ..... E04H 3/20

[52] U.S. Cl. ..... 15/1.7; 15/400

[58] Field of Search ..... 15/1.7, 393, 398, 399, 15/400, 375, 402

[56] References Cited

U.S. PATENT DOCUMENTS 2,972,771 2/1961 Kemper ..... 15/400 X 3,797,066 3/1974 Zaidan ..... 15/402

FOREIGN PATENT DOCUMENTS

6208/27 of 1927 Australia ..... 15/398

1093060 11/1960 Fed. Rep. of Germany ..... 15/400

1094940 12/1954 France ..... 15/400

6609316 1/1968 Netherlands ..... 15/400

135033 11/1919 United Kingdom ..... 15/398

*Primary Examiner*—Edward L. Roberts

*Attorney, Agent, or Firm*—William T. Howell

[57] ABSTRACT

A vacuum head for cleaning underwater surfaces has a depending skirt; the head, on its underside, has a brush depending therefrom with means on the underside to support the brush, which means is spaced inward of the skirt and is provided with apertures located between the brush and the head.

5 Claims, 5 Drawing Figures

VACUUM HEAD FOR CLEANING UNDERWATER SURFACES

FIELD OF INVENTION

This invention relates to hydraulic suction heads for cleaning underwater surfaces, more particularly, the bottom of a water reservoir such as a swimming pool. In the usual manner, such hydraulic suction heads are carried by a flexible tube leading from a suction source, which flexible tube is connected to the head through an upstanding integral tube to the head, located more or less at the centre thereof.

Suction heads of this type are provided with a downwardly depending brush, of various formations, which is intended to sweep the underwater surface and dislodge the material thereon for extraction through the withdrawal of the water drawn into the suction head. Various arrangements of the brush, and ideas for making the vacuum head more efficient, are shown in U.S. Pat. Nos. 3,008,160, 3,039,122 and 4,275,474.

A problem of suction heads of the type referred to above is that they have to be operated slowly without undue disturbance of the water. If they are moved too rapidly, the action of the brush disturbs the material to such an extent that the resulting turbulence causes the material to escape from the coverage of the suction head and a period of time must elapse before a sediment is reformed for the vacuum head to be applied again.

Another factor in designing a suction head which will operate efficiently and quickly is that the material on the underwater surface can be divided into two categories, the removal of each involving different considerations. Firstly, there is the material which adheres to the underwater surface and has to be dislodged before it is drawn into the suction head; this is the material which the brush is intended to dislodge with immediate suction through the head. Secondly, there is the non-adherent material which can be removed without the application of a brush; in practice, the application of the latter increases the problem of the removal of the non-adherent material and even the slowest of movement of the brush enables some of the non-adherent material to float away outside the coverage of the suction head.

SUMMARY OF THE INVENTION

It is an object of the invention to provide a quick acting suction head, with a brush thereto, which separates the function of removal of the non-adherent material from the removal of the adherent material in cleaning an underwater surface such as a swimming pool.

The invention resides in providing a vacuum head with a depending skirt, the head having on its underside a brush depending therefrom, with means on the underside of said head to support the brush, said means being spaced inward from said skirt and provided with apertures located between the brush and the underside of the head. As a result, on movement of the head, the first action is to draw in the non-adherent material through the apertures after which the brush, which extends below the skirt, sweeps the underwater surface to raise the adherent material and draw it through or under the brush.

DESCRIPTION OF THE DRAWINGS

The invention will now be described in relation to the accompanying drawings in which.

DESCRIPTION OF A PREFERRED EMBODIMENT

Figure 1:
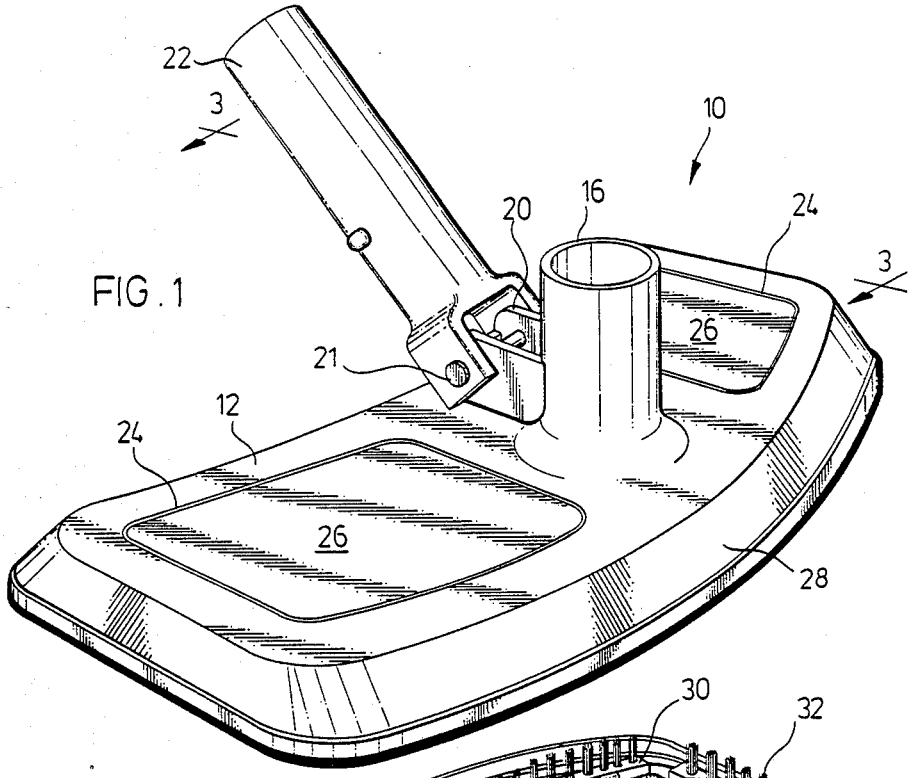
FIG. 1 is a top perspective view of an embodiment of a vacuum head constructed according to the invention.
Figure 2:
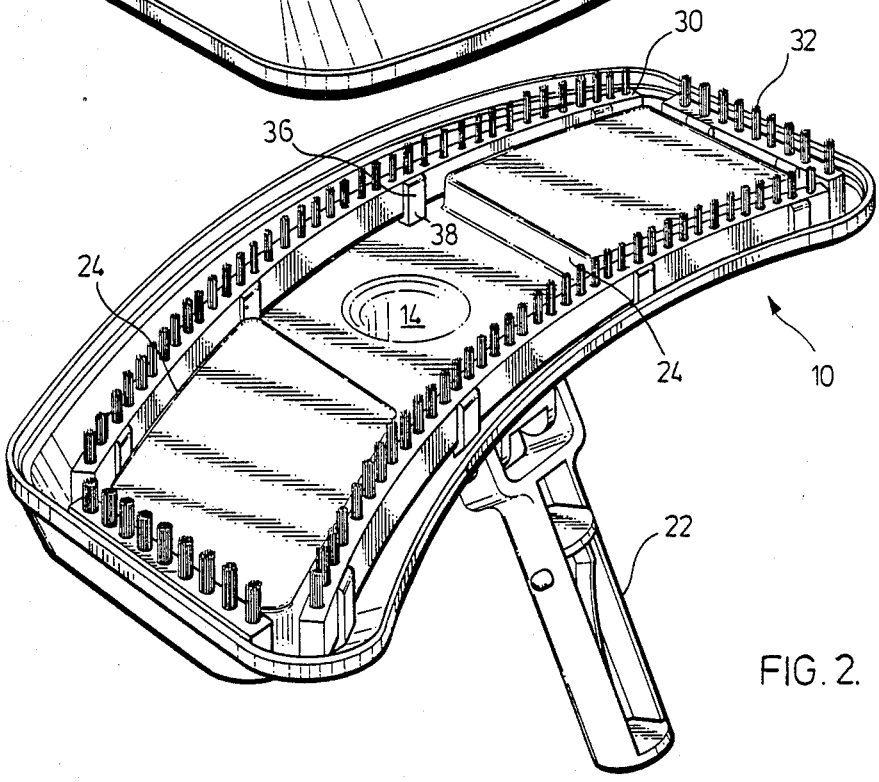
FIG. 2 is a bottom perspective view of the vacuum head shown in FIG. 1.

Referring now more particularly to the drawings and the reference numbers thereon, in which like numbers represent like parts, the novel hydraulic suction head comprises an elongated, transversely extending suction housing, indicated generally by the numeral 10, and having a transverse wall 12 with a centrally disposed opening 14 which is the open end of an upwardly extending neck 16 integrally secured to to the upper side of the transverse wall 12, as shown.

The neck 16 is connected in the usual manner to a flexible hose 18 leading to a suction source, not shown. The transverse wall 12 has a bracket 20, shown to be integral with the neck 16, which bracket 20 carries a pin 21 securing a hinged member 22 to the bracket 20. The hinged member 22 is adapted to carry a pole, not shown, which is used to guide the vacuum head 10 over the underwater surface to be cleaned.

The upper side of the transverse wall 12 has a pair of depressions 24, separated by the neck 16; each depression 24 carries a lead weight 26 and these bear the vacuum head 10 against the underwater surface.

A peripheral skirt 28 depends from the transverse wall 12 of the vacuum housing 10. Inward of the skirt 28, and spaced therefrom, the underside of the transverse wall 12 carries a member 30 which is adapted to support a downwardly depending brush 32, the end of which terminates below the edge of the skirt 28. The brush 32 may be of any configuration which will adequately sweep the underwater surface but is particularly shown as regularly spaced apart groups of bristles thus providing a channel between each adjacent pair.

Figure 3:
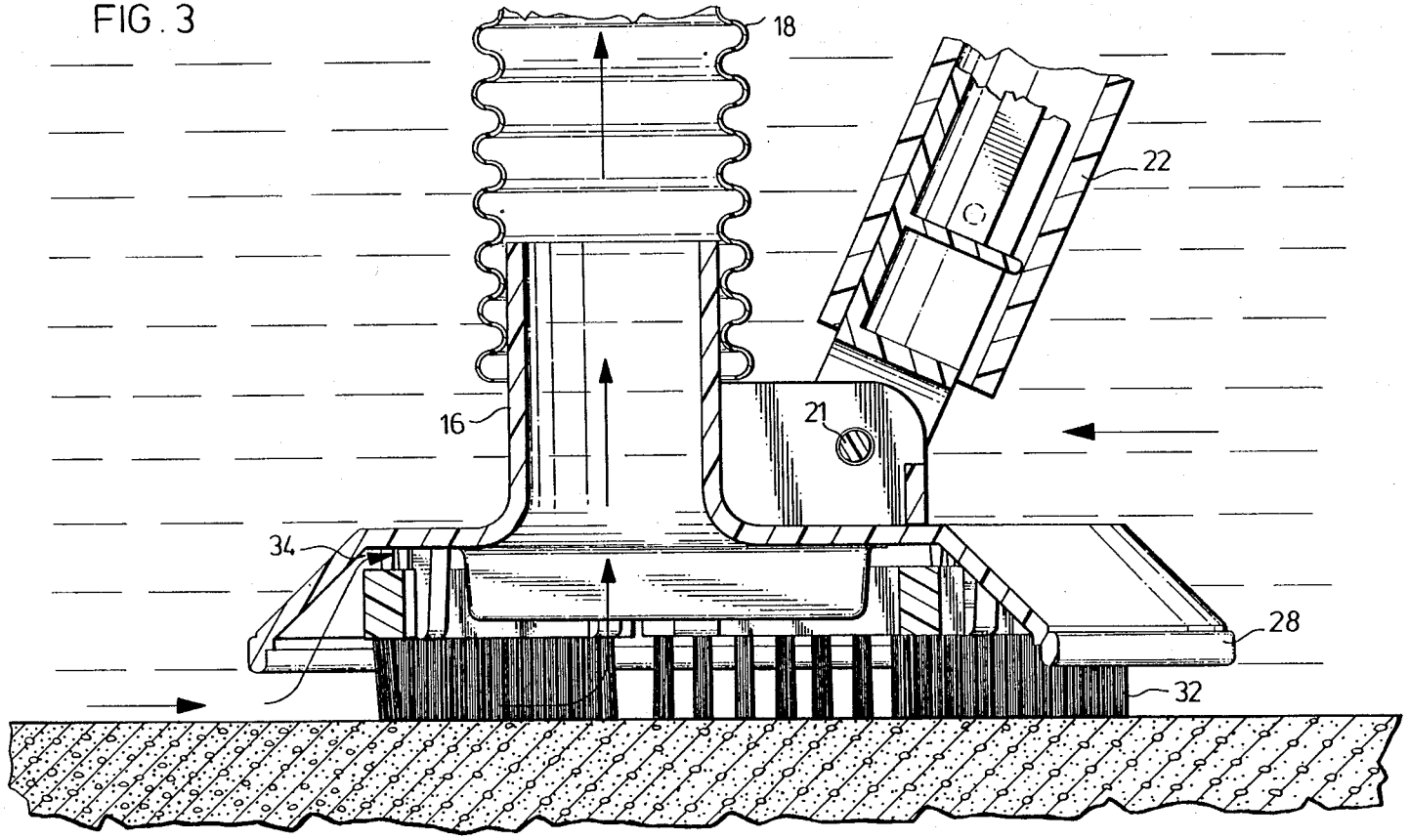
FIG. 3 is a cross section taken on the lines 3—3 of FIG. 1.
Figure 4:
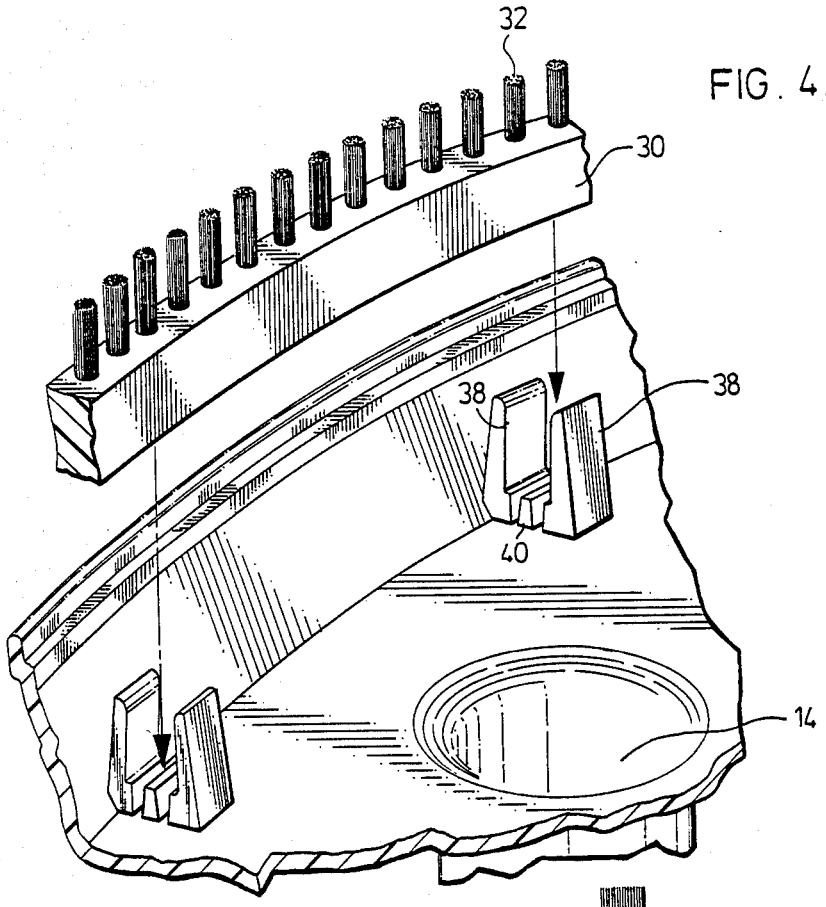
FIGS. 4 and 5 show a perspective and detail respectively of part of the vacuum head already illustrated and showing the removable feature of the brush preferably employed.

It is a feature of the invention that the member 30 is provided with apertures 34 located as shown, adjacent the underside of the transverse wall 12. As a result, and as shown in FIG. 3, the initial action of the vacuum head 10 is to remove loose material located between the edge of the skirt 28 and the member 30 through the apertures 34 and before such material has been disturbed by the brush 32. On further movement of the vacuum head, the brush 32 acts on the adjacent adherent material and this is removed through the channels between the pairs of bristles of the brush 32.

Figure 5:
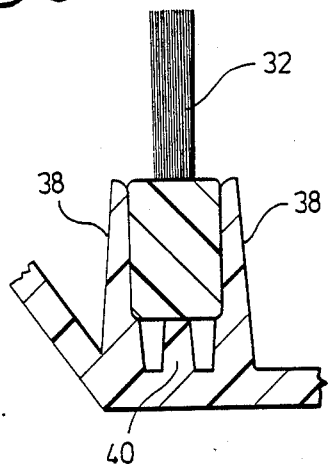

It is further feature of the vacuum head of the invention that the member 30 is removably secured to the underside of the transverse wall 12. This is accomplished by providing spaced apart pairs of clips 36 into which the member 30 may be inserted for snap attachment, the clips 36 being formed of opposed arms 38 having spring like characteristics. At the root of each clip 36, and located between the arms 38, is a projection 40, the purpose of which is to provide a stop for the entry of the member 30 into the clip 36, thus ensuring the provision of the apertures 34; the removable securement described above is illustrated in FIG. 5.

The vacuum head, as described above, is preferably made of plastic, apart of course from the head weights 26, which provide the necessary weight to submerge the head during operation.

I claim:

1. A vacuum head for cleaning swimming pool underwater surfaces comprising a transverse wall, an integral skirt depending downwardly from the perimeter of said transverse wall, an upwardly extending integral conduit to said transverse wall, said conduit being adapted for sealing connection to a flexible vacuum hose, a brush member securable to the underside of said transverse wall, spaced inward of said skirt and around said conduit in spaced relationship therefrom, bristles on said brush member extending into a plane below that of the lower edge of said skirt, said conduit providing for suction of the material disturbed by the action of said bristles on said underwater surface, a plurality of apertures defined by spacing said brush member from the underside of said transverse wall, said apertures providing for suction therethrough to said conduit of the suspended material contained in the water located between said skirt and said bristles, said vacuum head being made of a plastic material and weights attached to said transverse wall to sink said vacuum head to said underwater surfaces.

2. A vacuum head according to claim 1 wherein said brush member is removably secured to said underside of said transverse wall.

3. A vacuum head according to claim 2 wherein said brush member includes a bar secured in spring like clips formed of spaced apart arms integral with said underside of said transverse wall.

4. A vacuum head according to claim 3 wherein each said spaced apart arms has a projection intermediate thereof, which projection provides a stop for said brush member to form said apertures.

5. A vacuum head according to claim 1 wherein said bristles are formed as regularly spaced apart bunches on said brush member.

* * * * *